US006808444B1

(12) United States Patent
Kuprin et al.

(10) Patent No.: US 6,808,444 B1
(45) Date of Patent: Oct. 26, 2004

(54) POLISHING FIXTURE FOR FIBER OPTIC CONNECTORS

(75) Inventors: Igor Kuprin, Buffalo Grove, IL (US); Igor Grois, Northbrook, IL (US)

(73) Assignee: Molax Incorporated, Lisle, IL (US)

( * ) Notice: Subject to any disclaimer, the term of this patent is extended or adjusted under 35 U.S.C. 154(b) by 0 days.

(21) Appl. No.: 10/722,826

(22) Filed: Nov. 26, 2003

(51) Int. Cl.[7] ..... B24B 5/00

(52) U.S. Cl. ..... 451/292; 451/364; 451/365; 451/379; 451/398; 451/909

(58) Field of Search ..... 451/292, 364, 451/365, 379, 397, 398, 909

(56) References Cited

U.S. PATENT DOCUMENTS 5,107,627 A * 4/1992 Mock et al. ..... 451/271
5,321,917 A * 6/1994 Franklin et al. ..... 451/386
6,718,111 B1 * 4/2004 Suek et al. ..... 385/137

* cited by examiner

*Primary Examiner*—Joseph J. Hail, III
*Assistant Examiner*—Shantese McDonald
(74) *Attorney, Agent, or Firm*—Romi N. Bose

(57) ABSTRACT

A polishing fixture is provided for polishing the optic ends of a fiber optic cable terminated in a fiber optic connector. A holding plate has a receptacle for receiving the fiber optic connector, with at least a portion of each of a first side and a second side of the connector exposed. A clamping arm is disposed for linear movement relative to the holding plate and the received connector, as well as for pivotal movement relative to the holding plate and the received connector. The clamping arm has first and second clamping portions for engaging the first and second sides, respectively, of the connector. An actuator mechanism is operatively associated with the clamping arm for moving the clamping arm linearly to bring the first clamping portion of the arm into clamping engagement with the first side of the connector and then pivoting the clamping arm to bring the second clamping portion of the arm into clamping engagement with the second side of the connector.

25 Claims, 6 Drawing Sheets

POLISHING FIXTURE FOR FIBER OPTIC CONNECTORS

FIELD OF THE INVENTION

This invention generally relates to the art of fiber optic connectors and, particularly, to a polishing fixture for polishing the optic ends of a fiber optic cable terminated in a fiber optic connector.

BACKGROUND OF THE INVENTION

Fiber optic connectors of a wide variety of designs have been employed to terminate optical fiber cables and to facilitate connection of the cables to other cables or other optical fiber transmission devices. A typical optic fiber connector includes a ferrule that mounts and centers an optical fiber or fibers within the connector. The ferrule may be fabricated of such material as ceramic. A ferrule holder or other housing component of the connector embraces the ferrule and may be fabricated of such material as molded plastic. A spring may be disposed within the housing or ferrule holder such that the ferrule is yieldably biased forwardly for engaging another fiber-mounting ferrule of a mating connecting device.

Before a fiber optic cable can be joined to the end of a like cable to create a continuous fiber optic cable assembly, it is necessary to polish the ends of the tiny optical fibers at a mating face of the ferrule. It is often necessary to polish these optic ends to a precise length which they project from the mating face of the ferrule.

Polishing machines are known for performing such polishing functions, and the machines typically include a polishing fixture for receiving and holding one or more ferrules having the fiber optic cables terminated thereto. The ferrule must be clamped rigidly in the fixture. Typically, the ferrules are clamped in at least two directions, such as mutually perpendicular "X" and "Y" directions. This requires multiple clamping assemblies on the fixture. For instance, one clamping assembly is used to clamp the ferrule in the "X" direction, and a second clamping assembly is used for clamping the ferrule in the "Y" direction. Each assembly includes a plurality of components, and the dual assemblies double the number of components required. In essence, such fixtures and clamping assemblies are complicated, expensive and not very cost efficient. The present invention is directed to providing a polishing fixture that uses a single clamping assembly for clamping a ferrule in two different directions.

SUMMARY OF THE INVENTION

An object, therefore, of the invention is to provide a new and improved polishing fixture of the character described.

In the exemplary embodiment of the invention, a polishing fixture is provided for polishing the optic ends of a fiber optic cable terminated in a fiber optic connector. Note that discussions herein regarding fiber optic connectors also apply to multi-fiber optic connectors as well. The fixture includes a holding plate having a receptacle for receiving the fiber optic connector, with at least a portion of each of a first side and a second side of the connector exposed. A clamping arm is disposed for generally linear movement relative to the holding plate and the received connector, as well as for pivotal movement relative to the holding plate and the received connector. The clamping arm has first and second clamping portions for engaging the first and second sides, respectively, of the connector. An actuator mechanism is operatively associated with the clamping arm for moving the clamping arm generally linearly to bring the first clamping portion of the arm into clamping engagement with the first side of the connector and then pivoting the clamping arm to bring the second clamping portion of the arm into clamping engagement with the second side of the connector.

According to one aspect of the invention, the holding plate is circular, with a circular peripheral edge. A plurality of the receptacles are arranged in an array angularly about at least a portion of the circular peripheral edge of the plate, in conjunction with a corresponding plurality of the clamping arms and actuator mechanisms. Each receptacle is open at a top surface of the holding plate to expose the first side of the connector, and at least a portion of the receptacle is open at a side thereof to expose the second side of the connector.

As disclosed herein, the first and second sides of the fiber optic connector are disposed generally perpendicular to each other, as in a typical ferrule of a fiber optic connector assembly.

According to another aspect of the invention, the first and second clamping portions of the clamping arm comprise first and second surfaces generally perpendicular to each other. The clamping arm is generally L-shaped to define first and second, mutually perpendicular legs that form the first and second clamping portions of the clamping arm. The clamping arm is pivotally movable about a pivot point generally at a juncture of the perpendicular legs of the L-shaped clamping arm.

According to a further aspect of the invention, the actuator mechanism includes an actuating lever pivotally mounted at one end thereof to a fixed pivot on the holding plate. An opposite end of the actuating lever is pivotally connected to the clamping arm. A set screw is freely rotatable in a through hole in the actuating lever and is threadably engaged in a screw hole in the holding plate to move the actuating lever and effectively move the clamping arm. The set screw has an enlarged, manually graspable knob to facilitate manually rotating the screw. The receptacle in the holding plate defines an insertion axis of the connector, and an axis of the screw hole is at an acute angle to the insertion axis. The holding plate has a first clamping surface against which the connector is clamped by the first clamping portion of the clamping arm, and the holding plate has a second clamping surface at an angle to the first clamping surface and against which the actuating lever is clamped by the set screw.

Other objects, features and advantages of the invention will be apparent from the following detailed description taken in connection with the accompanying drawings.

BRIEF DESCRIPTION OF THE DRAWINGS

The features of this invention that are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DESCRIPTION

Figure 1:
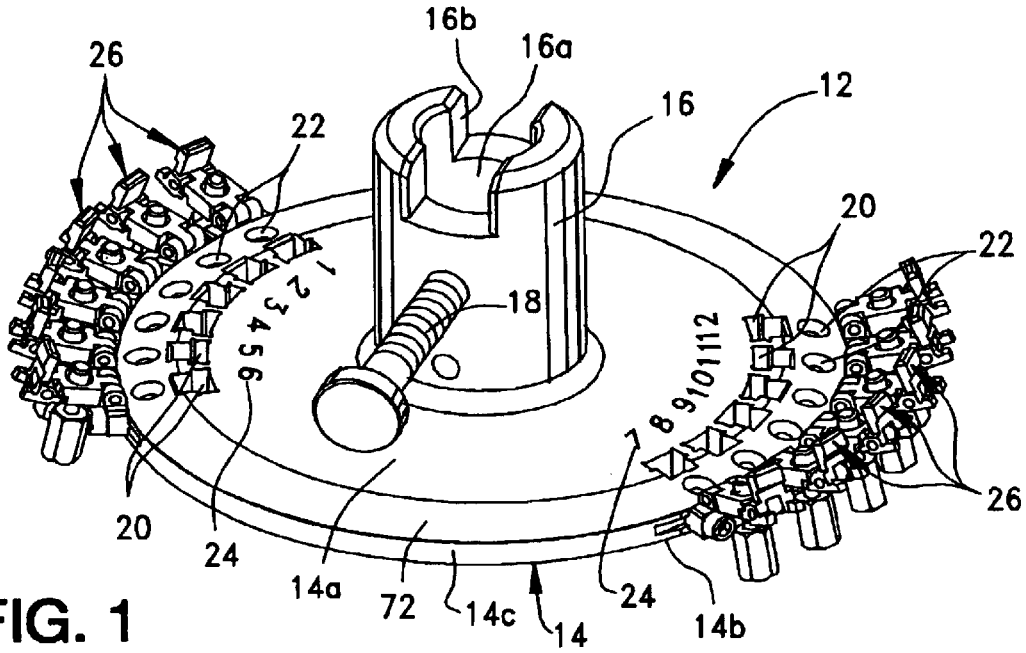
FIG. 1 is a perspective view of a polishing fixture incorporating the concepts of the invention, with the clamping assemblies in their open positions.

Referring to the drawings in greater detail, and first to FIG. 1, the invention is embodied in a polishing fixture, generally designated 12, for polishing the optic ends of a fiber optic cable (not shown) terminated in a fiber optic connector, as will be seen hereinafter. Actually, polishing fixture 12 is provided for simultaneously polishing the optic ends of a plurality of fiber optic cables terminated in a plurality of fiber optic connectors.

As seen in FIG. 1, polishing fixture 12 includes a circular holding plate, generally designated 14, having a top flat surface 14*a*, a bottom flat surface 14*b* and a flattened circular peripheral edge 14*c*. An upstanding mounting post 16 is fixed to the top of the holding plate. The mounting post is hollow, as at 16*a*, for mounting on the arm of a polishing machine above a rotatable polishing table (not shown). The mounting post is notched, as at 16*b*, at the top thereof for preventing fixture rotation. A large set screw 18 fixes the mounting post and, thereby, holding plate 14 to the arm of the polishing machine.

Still referring to FIG. 1, holding plate 14 includes a pair of arcuate arrays of receptacles 20 at diametrically opposite sides of the holding plate for receiving a plurality of fiber optic connectors, as will be seen hereinafter. A respective plurality of internally threaded through holes 22 are located outside the receptacles, for purposes to be described hereinafter. Numeral indicia 24 may be imprinted on top of the holding plate to identify the individual receptacles 20. Finally, a plurality of clamping assemblies, generally designated 26, are mounted at edge 14*c* of holding plate 14 generally in radial alignment with receptacles 20 and internally threaded through holes 22. As can be seen by the numerical indicia 24, there are six receptacles 20 in arcuate arrays at opposite sides of holding plate 14, along with a corresponding six through holes 20 and a corresponding six clamping assemblies 26 all in radial alignment of the circular holding plate.

Figure 2:
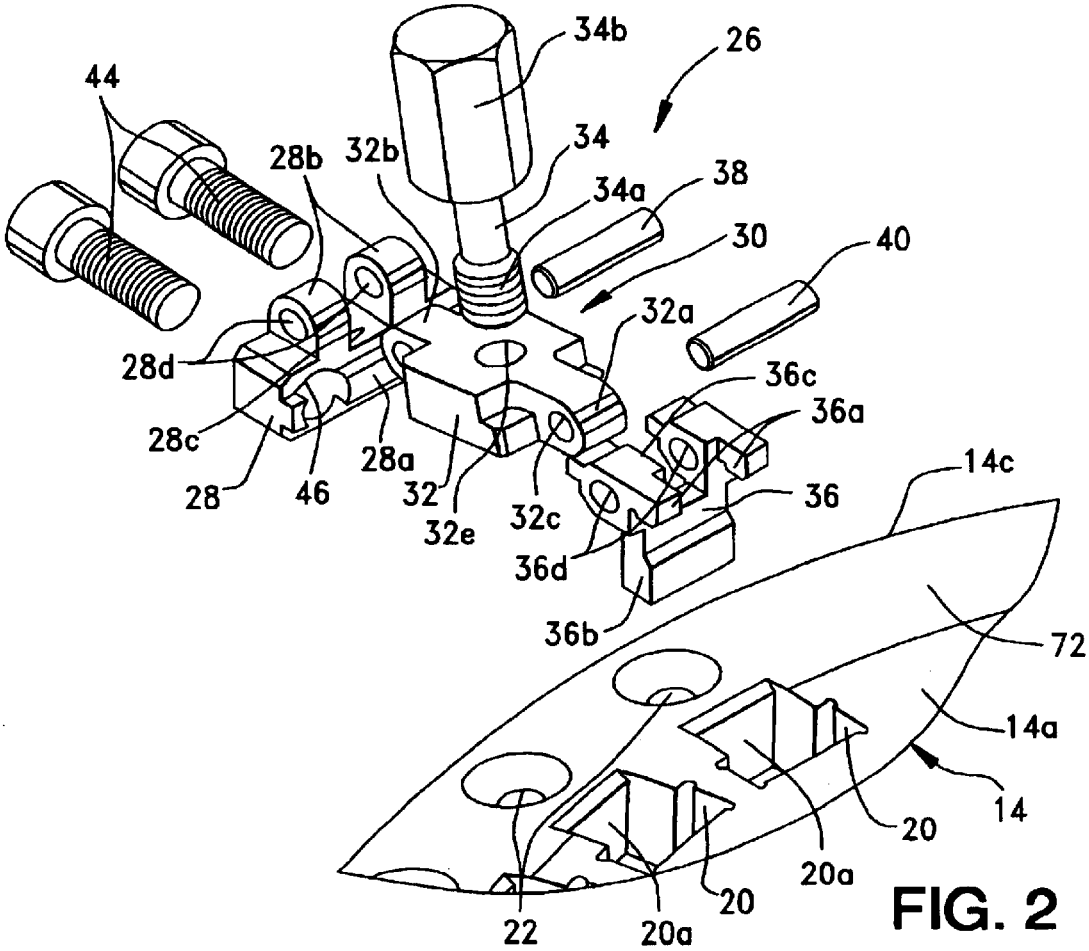
FIG. 2 is an enlarged, exploded perspective view of one of the clamping assemblies.
Figure 3:
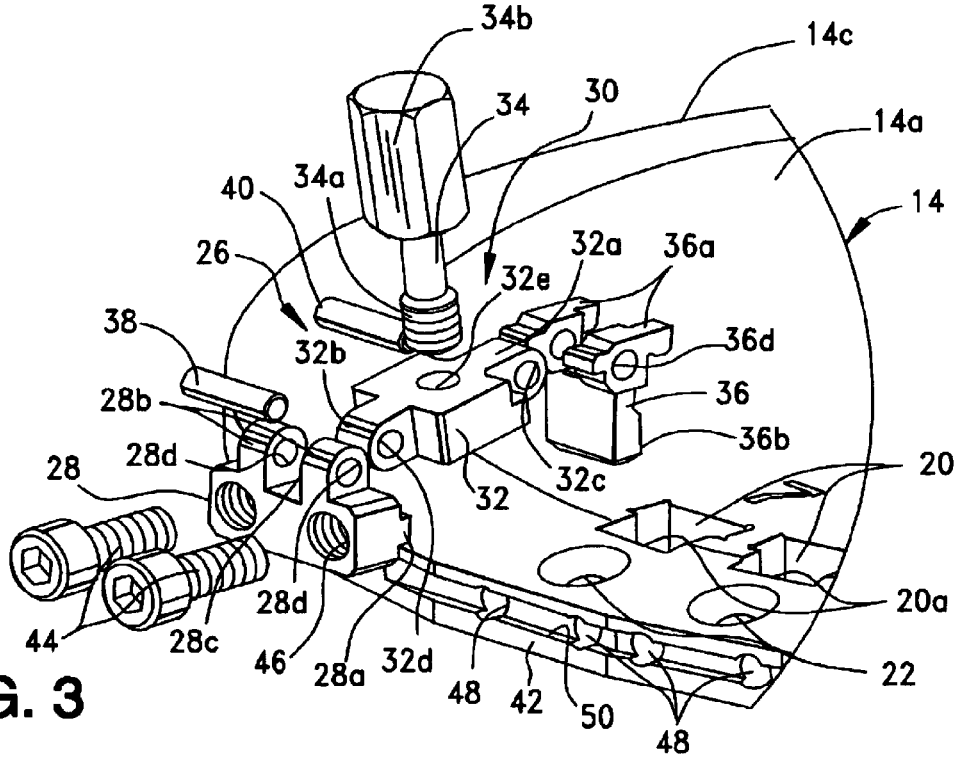
FIG. 3 is a view similar to that of FIG. 2, but at a different angle.

Referring to FIGS. 2 and 3 in conjunction with FIG. 1, each clamping assembly 26 includes a pivot block 28; an actuator mechanism, generally designated 30, which includes an actuating lever 32 and a set screw 34; and a clamping arm 36. Actuating lever 32 is pivotally connected to pivot block 28 by a pivot pin 38, and the actuating lever is pivotally connected to clamping arm 36 by a pivot pin 40.

Keeping in mind that one clamping assembly 26 is provided in radial alignment with each receptacle 20 and the corresponding internally threaded through hole 22, FIG. 3 shows that pivot block 28 is fixed to a flattened portion 42 of peripheral edge 14*c* of holding plate 14 by a pair of externally threaded machine screws 44. The screws extend through a pair of holes 46 in pivot block 28 and are securely threaded into a pair of internally threaded holes 48 in holding plate 14. An elongated tongue 28*a* is integral with pivot block 28 and seats in a groove 50 at the edge of the holding plate to stabilize the pivot block. A pair of pivot ears 28*b* project upwardly from the pivot block and define a slot 28*c* therebetween. Finally, pivot ears 28*b* have through holes 28*d* for receiving pivot pin 38.

Referring to FIGS. 2 and 3 in conjunction with FIG. 1, actuating lever 32 of actuator mechanism 30 of clamping assembly 26 includes a front pivot boss 32*a* and a rear pivot boss 32*b*. The front pivot boss includes a generally horizontal through hole 32*c*, and rear pivot boss 32*b* includes a through hole 32*d*. A through hole 32*e* extends vertically through the actuating lever. Pivot boss 32*b* is positioned in slot 28*c* between ears 28*b* of pivot block 28 to align through hole 32*d* of the pivot boss with through holes 28*d* in pivot ears 28*b* for receiving pivot pin 38. This provides a pivotal connection between actuating lever 32 and fixed pivot block 28. Set screw 34 is freely rotatably positioned within through hole 32*e* of actuating lever 32 and has an externally threaded portion 34*a* for threading into one of the internally threaded holes 22 in holding plate 14. The set screw has an enlarged, manually graspable knob 32*b*, which may be hexagon-shaped, to facilitate manual and/or torque-wrench rotation of the set screw.

Figure 6:
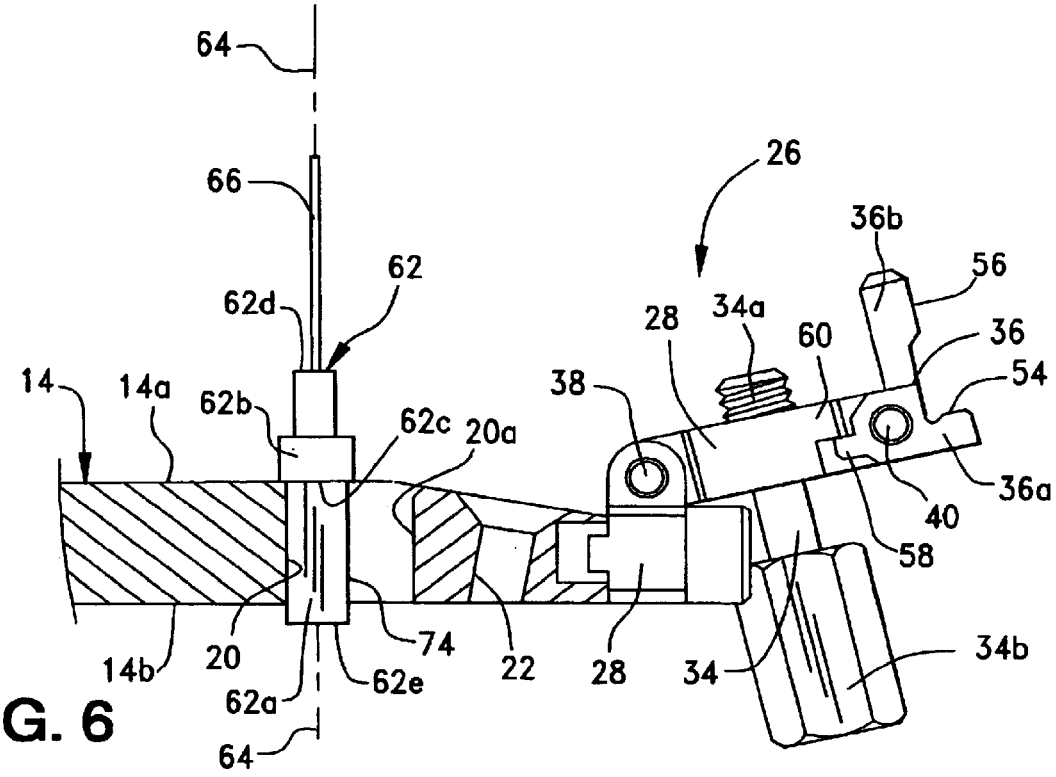
FIG. 6 is an enlarged vertical section taken generally along line 6—6 of FIG. 5B.

Referring to FIG. 6 in conjunction with FIGS. 2 and 3, clamping arm 36 is generally L-shaped to define first and second, mutually perpendicular legs 36*a* and 36*b*, respectively. Actually, first leg 36*a* is bifurcated as seen in FIGS. 2 and 3 to define a slot 36*c* that receives pivot boss 32*a* of actuating lever 32. Through hole 32*c* of the actuating lever becomes aligned with a pair of through holes 36*d* in bifurcated leg 36*a* for receiving pivot pin 40 to form a pivot connection between the actuating lever and clamping arm 36. In essence, holes 36*d* in the clamping lever define a pivot point generally at the juncture between legs 36*a* and 36*b*.

FIG. 6 shows that leg 36*a* has a clamping surface 54 and leg 36*b* has a. clamping surface 56 that is perpendicular to clamping surface 34. As will be understood hereinafter, first and second legs 36*a* and 36*b*, respectively, form first and second clamping portions of clamping arm 36. FIG. 6 also shows that clamping arm 36 has a stop flange 58 that engages a stop flange 60 of pivot block 28 to define the extreme open position of the clamping arm.

Figure 4:
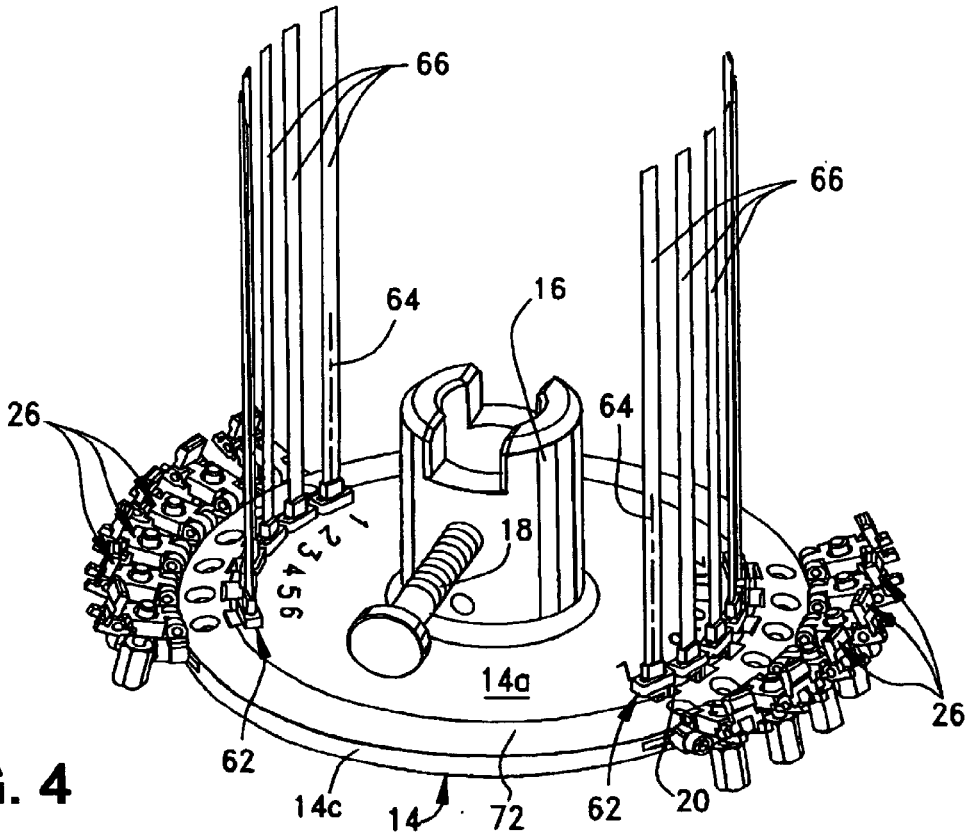
FIG. 4 is a view similar to that of FIG. 1, but with a plurality of fiber optic connectors and terminated fiber optic cables loaded into the fixture.
Figure 5A:
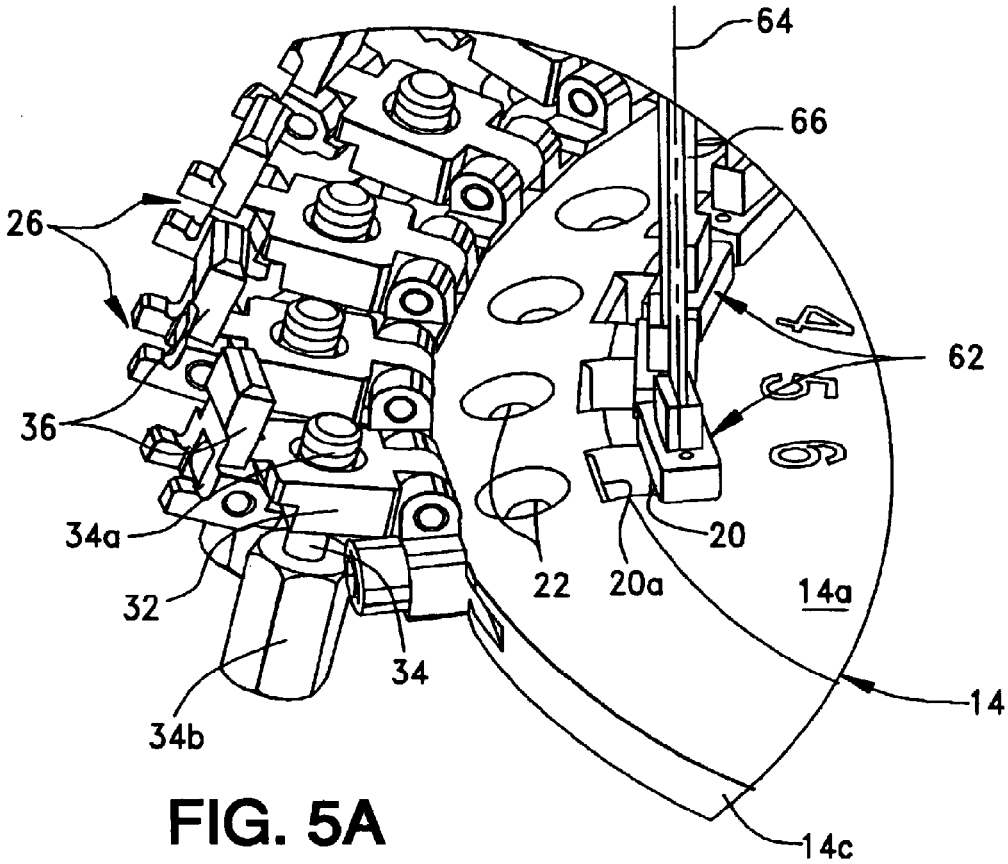
FIGS. 5A and 5B are enlarged perspective views, at different angles to each other and showing a portion of the polishing fixture with a plurality of the clamping assemblies in their open positions and the connectors and cables loaded in the fixture.
Figure 5B:
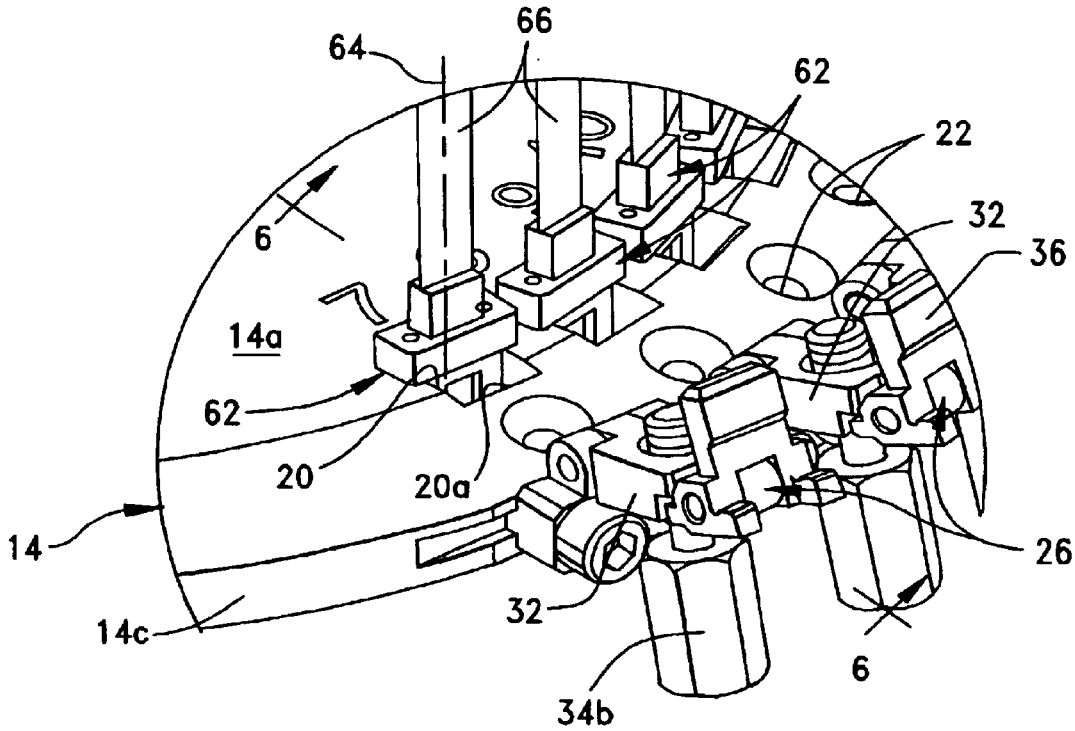

FIGS. 4–6 show clamping assemblies 26 in their open position, and a plurality of fiber optic connectors, generally designated 62, are positioned into receptacles 20 on insertion axes 64. Connectors 62 shown herein are the ferrules described in the "Background", above. The ferrules terminate fiber optic cables 66. Each ferrule 62 includes a body portion 62*a* and an enlarged peripheral flange portion 62*b*. The peripheral flange portion defines a bottom peripheral surface 62*c* and a top peripheral surface 62*d*. Body portion 62*a* defines a mating surface 62*e* at which the optic ends of the tiny optical fibers (not shown) of cables 66 are exposed for polishing. When each ferrule 62 is inserted into one of the receptacles 20, bottom peripheral flange 62*c* of peripheral flange portion 62*b* engages top surface 14*a* of holding plate 14. Finally, as clearly seen in FIGS. 5A, 5B and 6, receptacles 20 are enlarged to define open areas 20*a* that will receive second legs or clamping portions 36*b* of clamping arms 36 as will be seen hereinafter.

Figure 7:
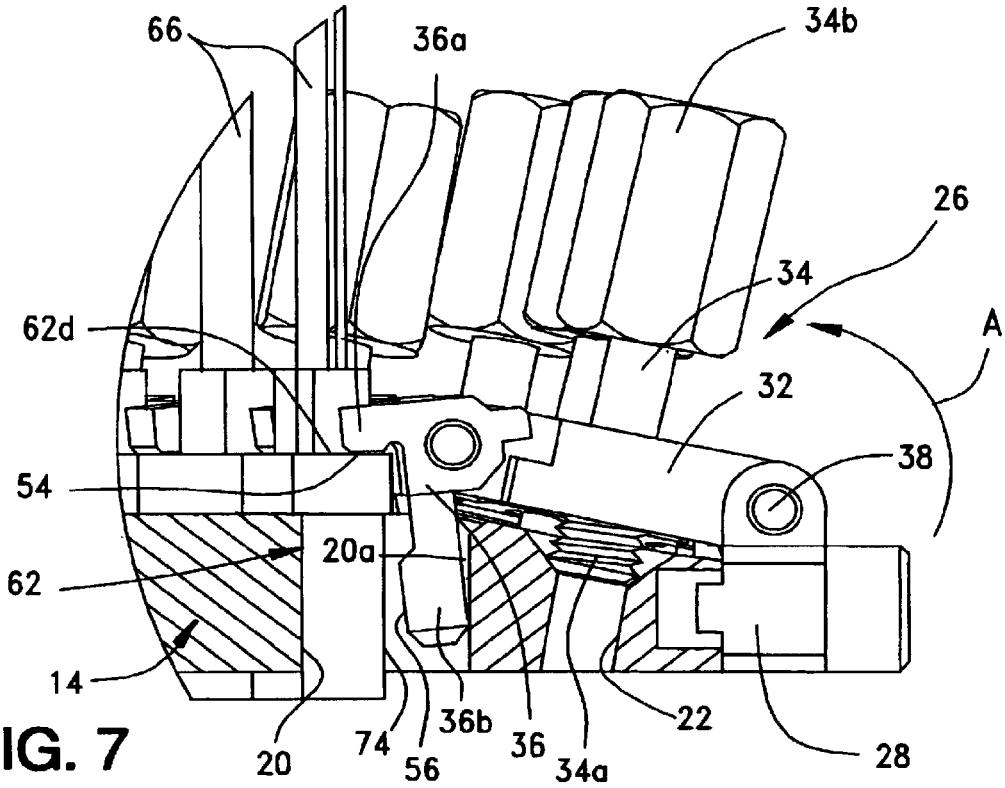
FIG. 7 is a fragmented perspective view, partially in section, showing several of the clamping assemblies in their closed (but not clamping) positions.
Figure 8:
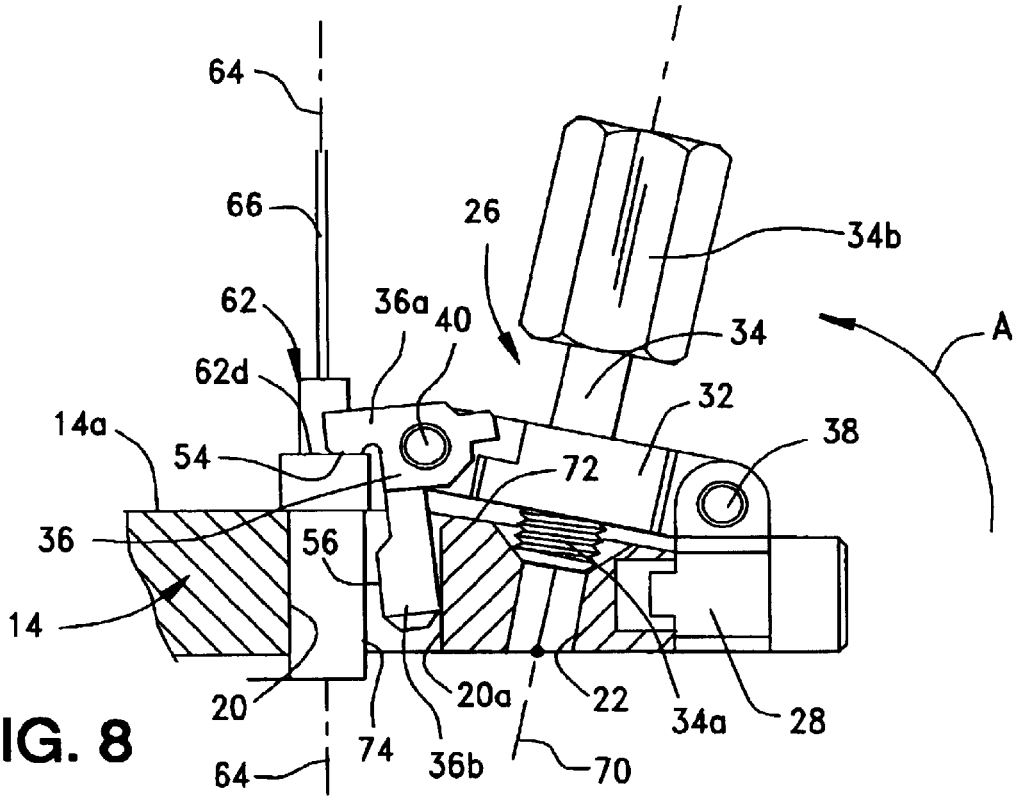
FIG. 8 is a view similar to that of FIG. 6, but with the clamping assembly in the position of FIG. 7.

FIGS. 7 and 8 show actuating lever 32 and clamping arm 36 of one of the clamping assemblies 26 pivoted in the direction of arrow "A" about pivot pin 38 on pivot block 28. In this intermediate or closed and non-clamping position, second leg or clamping portion 36*b* of clamping arm 36 has moved into open area 20*a* of receptacle 20. First leg or clamping portion 36*a* of the clamping arm has moved to a position where clamping surface 54 has engaged the top peripheral surface 62*d* of ferrule 62. Externally threaded portion 34*a* of set screw 34 now is aligned with internally threaded hole 22 in the holding plate. It can be seen in FIG. 8 that axis 70 of hole 22 is at an acute angle relative to insertion axis 64 of ferrule 62 into receptacle 20. Axis 70 is perpendicular to an angled surface 72 about the periphery of holding plate 14. In essence, axis 70 of hole 22 is generally tangential to the pivot axis of pivot pin 38 so that set screw 34 can move axially and generally linearly notwithstanding the fact that actuating lever 32 actually moves pivotally about pivot pin 38.

Figure 9:
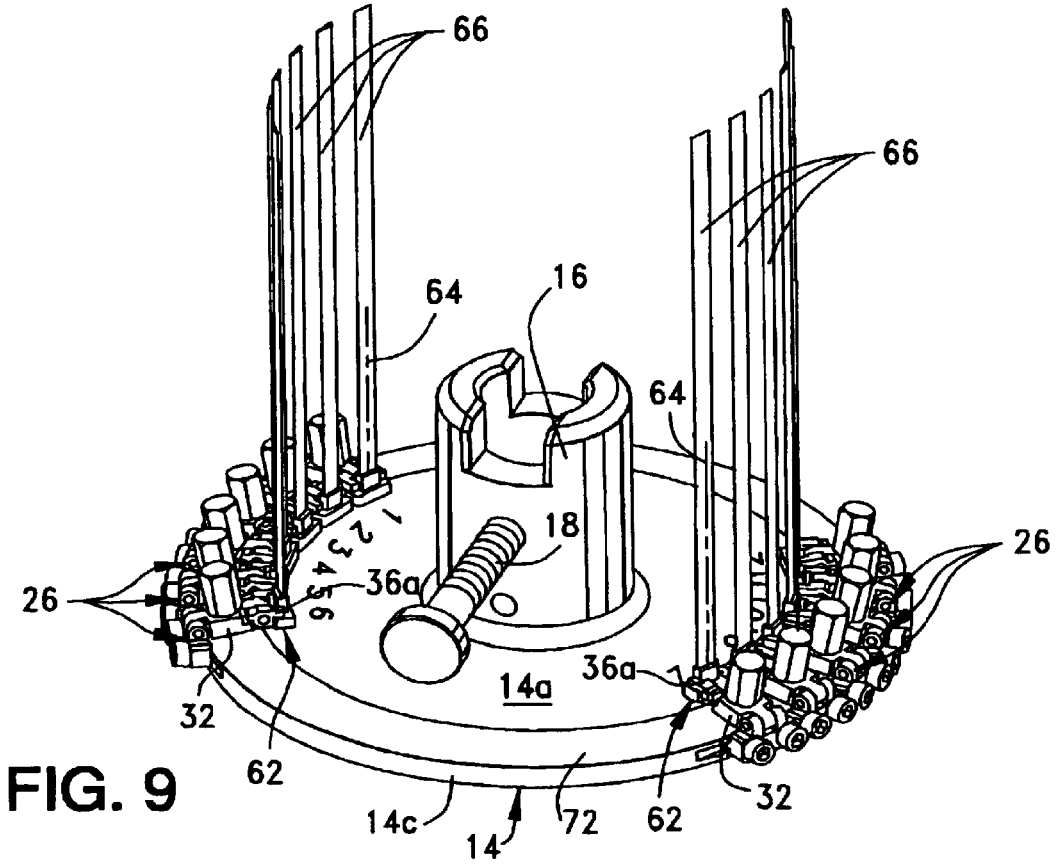
FIG. 9 is a view similar to that of FIG. 4, but with the clamping assemblies in their clamping positions.
Figure 10:
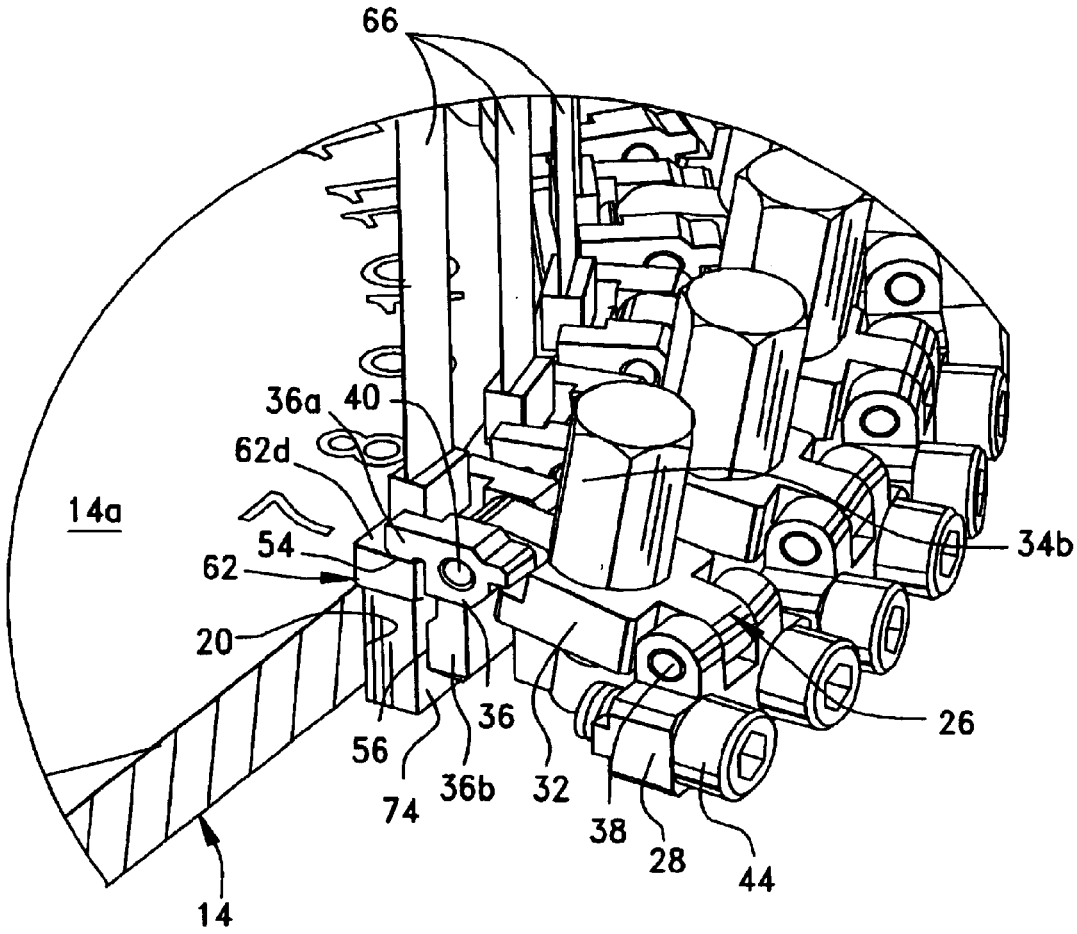
FIG. 10 is a view similar to that of FIG. 5B, but with the clamping assemblies in their clamping positions.
Figure 11:
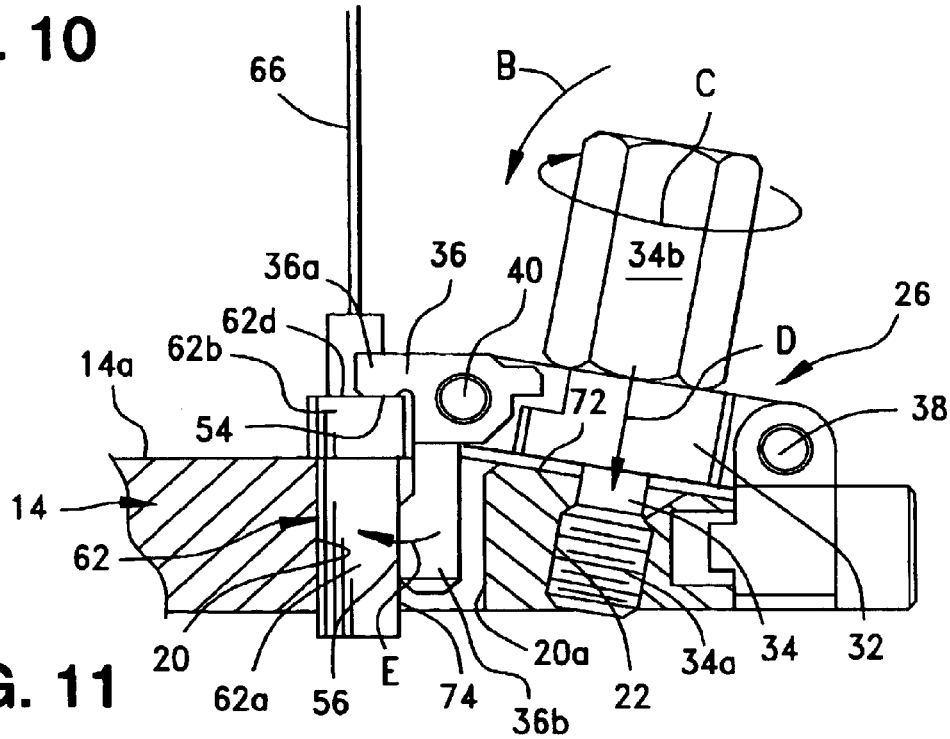
FIG. 11 is a view similar to that of FIGS. 6 and 8, but with the clamping assembly in its clamping position.

FIGS. 9–11 show actuating levers 32 and clamping arms 36 of clamping assemblies 26 pivoted about pivot pins 38 in the direction of arrow "B" (FIG. 11) to the full clamping positions of the assemblies. It can be seen best in FIG. 11 that clamping surface 54 of first leg or clamping portion 36a of clamping arm 36 still is in engagement with top peripheral surface 62*d* of peripheral flange portion 62*b* of ferrule 62. However, clamping surface 56 of the second leg or clamping portion 36*d* of clamping arm 36 now has come into engagement with a side surface 74 of body portion 62*a* of the ferrule. It can be seen that surfaces 62*d* and 74 of the ferrule are generally perpendicular to each other as are surfaces 54 and 56 on clamping arm 36. The assembly has been moved to this clamping position by manually rotating set screw 34 in the direction of arrow "C" to draw the set screw axially and linearly in the direction of arrow "D", as externally threaded portion 34*a* of the set screw is threaded into internally threaded hole 22 of the holding plate. Angled surface 72 of the holding plate allows actuating lever 32 to move downwardly a sufficient degree.

As best seen in FIG. 11, during the final clamping action of clamping assembly 26, surface 54 on clamping arm 36 acts as a fulcrum to draw surface 56 on the clamping arm in the direction of arrow "E" tightly against surface 74 of ferrule 62. In essence, clamping arm 36 is moved generally linearly or tangentially about pivot pin 38 by tightening set screw 34, while clamping arm 36 pivots about pivot pin 40 as surface 54 acts as a pivoting fulcrum to draw surface 56 against the ferrule. This multi-motion action on the clamping arm allows a single clamping assembly to clamp ferrule 62 in two mutually perpendicular directions, i.e., surfaces 54 and 56 of clamping arm 36 against surfaces 62*d* and 74, respectively, of ferrule 62.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A polishing fixture for polishing the optic ends of a fiber optic cable terminated in a fiber optic connector, comprising:

a holding plate having a receptacle for receiving the fiber optic connector with at least a portion of each of a first side and a second side of the connector exposed;

a clamping arm disposed for generally linear movement relative to the holding plate and the received connector as well as for pivotal movement relative to the holding plate and the received connector, the clamping arm having first and second clamping portions for engaging said first and second sides, respectively, of the connector; and an actuator mechanism operatively associated with the clamping arm for moving the clamping arm generally linearly to bring the first clamping portion of the arm into clamping engagement with the first side of the connector and then pivoting the clamping arm to bring the second clamping portion of the arm into clamping engagement with the second side of the connector.

2. The polishing fixture of claim 1 wherein said holding plate is circular with a circular peripheral edge, and said receptacle is located adjacent the edge.

3. The polishing fixture of claim 2 wherein said receptacle is open at a top surface of the holding plate to exposed said first side of the connector, and at least a portion of the receptacle is opening at a side thereof to expose said second side of the connector.

4. The polishing fixture of claim 3, including a plurality of said receptacles in an array angularly about the circular peripheral edge of the holding plate, in conjunction with a corresponding plurality of said clamping arms and actuator mechanisms.

5. The polishing fixture of claim 1 wherein said receptacle is located adjacent an edge of the holding plate, the receptacle being open at a top surface of the holding plate to expose said first side of the connector, and at least a portion of the receptacle is open at a side thereof to expose said second side of the connector.

6. The polishing fixture of claim 5, including a plurality of said receptacles along the peripheral edge of the holding plate, in conjunction with a corresponding plurality of said clamping arms and actuating mechanisms.

7. The polishing fixture of claim 1 wherein the first and second sides of the fiber optic connector are disposed generally perpendicular to each other, and the first and second clamping portions of said clamping arm include first and second surfaces generally perpendicular to each other.

8. The polishing fixture of claim 1 wherein said clamping arm is generally L-shaped to define first and second, mutually perpendicular legs that form the first and second clamping portions of the clamping arm.

9. The polishing fixture of claim 8 wherein said clamping arm is pivotally movable about a pivot point generally at a juncture of the perpendicular legs of the L-shaped clamping arm.

10. The polishing fixture of claim 1 wherein said actuator mechanism includes an actuating lever pivotally mounted at one end thereof to a fixed pivot on the holding plate.

11. The polishing fixture of claim 10 wherein an opposite end of said actuating lever is pivotally connected to said clamping arm.

12. The polishing fixture of claim 10, including a set screw freely rotatable in a through hole in the actuating lever and threadably engaged in a screw hole in the holding plate to move the actuating lever and effectively move the clamping arm.

13. The polishing fixture of claim 12 wherein said set screw has an enlarged, manually graspable knob to facilitate manually rotating the set screw.

14. The polishing fixture of claim 12 wherein the receptacle in said holding plate defines an insertion axis of the connector, and an axis of said screw hole is at an acute angle to said insertion axis.

15. The polishing fixture of claim 14 wherein said holding plate has a first clamping surface against which the connector is clamped by the first clamping portion of the clamping arm, the holding plate having a second clamping surface at an angle to the first clamping surface and against which said actuating lever is clamped by the set screw.

16. The polishing fixture of claim 1, wherein the fiber optic connector is a multi-fiber optic connector.

17. The polishing fixture of claim 12, wherein the set screw is configured to be rotated using a torque wrench.

18. A polishing fixture for polishing the optic ends of a fiber optic cable terminated in a fiber optic connector that has first and second sides disposed generally perpendicular to each other, comprising:

a holding plate having a receptacle located adjacent an edge of the plate for receiving the fiber optic connector, the receptacle being open at a top surface of the holding plate to expose said first side of the connector, and at least a portion of the receptacle being open at a side thereof to expose said second side of the connector;

a generally L-shaped clamping arm disposed for generally linear movement relative to the holding plate and the received connector as well as for pivotal movement relative to the holding plate and the received connector, the L-shaped clamping arm defining first and second mutually perpendicular legs that form first and second clamping portions for engaging said first and second sides, respectively, of the connector, the clamping arm being pivotally movable about a pivot point generally at a juncture of the perpendicular legs; and an actuator mechanism including an actuating lever pivotally mounted at one end thereof to a fixed pivot on the holding plate, an opposite end of the actuating lever being pivotally connected to the clamping arm for moving the clamping arm generally linearly to bring the first clamping portion of the arm into clamping engagement with the first side of the connector and then pivoting the clamping arm to bring the second clamping portion of the arm into clamping engagement with the second side of the connector.

19. The polishing fixture of claim 18, including a plurality of said receptacles along the peripheral edge of the holding plate, in conjunction with a corresponding plurality of said clamping arms and actuator mechanisms.

20. The polishing fixture of claim 19 wherein said holding plate is circular with a circular peripheral edge, and including a plurality of said receptacles in an array angularly about the peripheral edge of the holding plate, in conjunction with a corresponding plurality of said clamping arms and actuating levers.

21. The polishing fixture of claim 18 wherein said actuator mechanism includes a set screw freely rotatable in a through hole in the actuating lever and threadably engaged in a screw hole in the holding plate to move the actuating lever and effectively move the clamping arm.

22. The polishing fixture of claim 21 wherein said set screw has an enlarged, manually graspable knob to facilitate manually rotating the set screw.

23. The polishing fixture of claim 21 wherein the receptacle in said holding plate defines an insertion axis of the connector, and an axis of said screw hole is at an acute angle to said insertion axis.

24. The polishing fixture of claim 23 wherein said holding plate has a first clamping surface against which the connector is clamped by the first clamping portion of the clamping arm, the holding plate having a second clamping surface at an angle to the first clamping surface and against which said actuating lever is clamped by the set screw.

25. The polishing fixture of claim 21 wherein said set screw is configured to be rotated using a torque wrench.

* * * * *